United States Patent [19]

Engelhardt

[11] Patent Number: 4,556,104

[45] Date of Patent: Dec. 3, 1985

[54] HEAT EXCHANGER

[75] Inventor: Rolf D. Engelhardt, Grachtweg 1, D-5137 Waldfeucht/Obspringen, Fed. Rep. of Germany

[73] Assignee: Rolf Dieter Engelhardt, Waldfeucht/Obspringen, Fed. Rep. of Germany

[21] Appl. No.: 628,080

[22] Filed: Jul. 6, 1984

[30] Foreign Application Priority Data

Jul. 6, 1983 [DE] Fed. Rep. of Germany ... 8319454[U]

[51] Int. Cl.[4] ..... F28F 3/12

[52] U.S. Cl. ..... 165/145; 165/169; 122/160; 122/169; 122/249

[58] Field of Search ..... 165/169, 145; 122/155 R, 160, 161, 169, 249, 250 R

[56] References Cited

U.S. PATENT DOCUMENTS

| | | | |
|---|---|---|---|
| 1,133,563 | 3/1915 | Junkers | 122/250 R |
| 1,980,425 | 11/1934 | Morgan | 122/169 |
| 2,621,635 | 12/1952 | Jooster | 122/250 R |
| 2,650,808 | 9/1953 | Cohen et al. | 165/169 X |
| 2,823,652 | 2/1958 | Mader | 122/250 R |
| 3,280,903 | 10/1966 | Stoddard, Jr. | 165/169 X |
| 3,998,188 | 12/1976 | Priest et al. | 122/250 R |

*Primary Examiner*—Albert W. Davis, Jr.
*Assistant Examiner*—Peggy A. Neils
*Attorney, Agent, or Firm*—Karl F. Ross; Herbert Dubno

[57] ABSTRACT

A heat exchanger serving for the heating of an organic transfer liquid by combustion gases from a burner has a metallic housing in the shape of an upright cylinder with a widened upper part; the transfer liquid flows through an inner coil extending over nearly the full height of the housing and in series therewith through an outer coil surrounding the inner coil in the widened upper part. The two coils are enveloped by combustion gases, generated within or outside the housing, which rise from its bottom to the top inside the inner coil and then descend around the outer coil to an exit port provided near the lower end thereof. The top, bottom and upper cylinder part are overlain by conduits carrying a cooling fluid, preferably the same transfer liquid; in a preferred embodiment, these conduits are designed as half-pipes welded onto the outer housing surfaces to form cooling channels.

7 Claims, 1 Drawing Figure

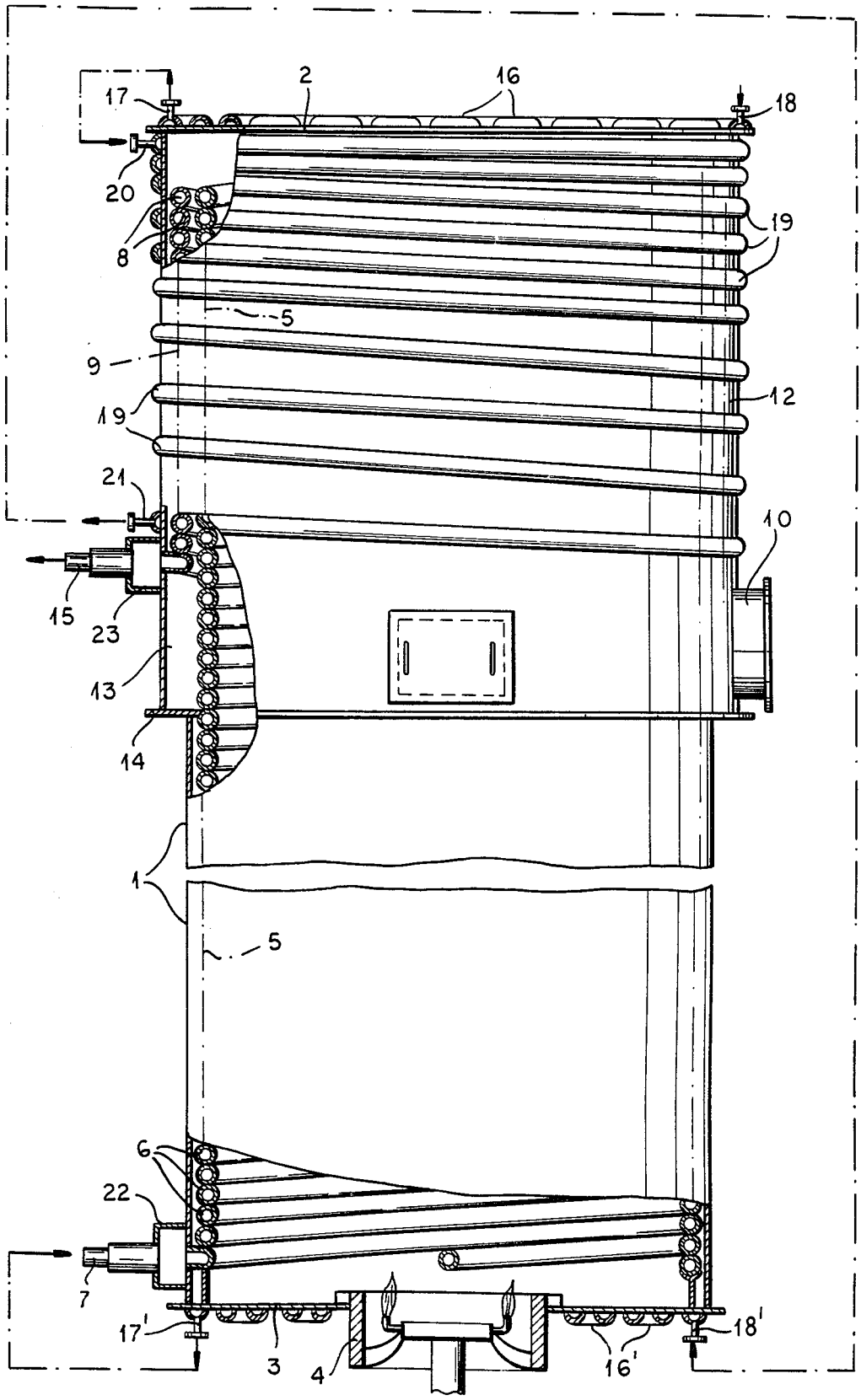
2
16
17
18
20
19
8
5
9
12
19
21
10
15
23
13
14
1
5
6
22
7
17'
18'
3
4
16'

HEAT EXCHANGER

FIELD OF THE INVENTION

My present invention relates to a heat exchanger for heating up a transfer fluid, especially an organic liquid, by means of combustion gases from a burner of fossil fuel.

BACKGROUND OF THE INVENTION

Heat exchangers of this kind usually have a generally cylindrical housing including a peripheral wall, centered on a vertical axis, whose ends are closed by a top and a bottom. The combustion gases, generated in the housing or admitted through its bottom, circulate in its interior around tubing traversed by the transfer fluid. The housing wall, manually made of steel, may be provided with a protective lining or heat shield of ceramic material, e.g. refractory bricks or tiles; this has the purpose of minimizing the loss of combustion heat due to thermal radiation.

Difficulties arise in such a structure because of the different thermal coefficients of expansion of the ceramic and metallic materials. Moreover, if the transfer fluid is an organic liquid such as a thermal oil, it is important to avoid any overheating thereof. This causes no problem during the operation of the heat exchanger. However, when the unit is turned off and the liquid no longer circulates, the heat stored in the ceramic materials may adversely affect the liquid still left in the tubing.

OBJECT OF THE INVENTION

It is thus the object of my present invention to provide an improved construction for a heat exchanger of the type referred to which obviates the need for a protective lining or heat shield.

SUMMARY OF THE INVENTION

I realize this object, in accordance with the present invention, by the provision of external cooling means surrounding at least part of the housing to prevent outward radiation without significant heat storage. The heat absorbed by the cooling means can be readily recovered, especially when cooling is carried out with the aid of a conduit system traversed by the transfer fluid passing through the internal tubing.

Such a conduit system advantageously comprises channels bounded in part by the metallic housing member themselves, the cooling fluid being confined by metallic elements such as half-pipes or half-shells welded onto the outer housing surfaces. These channels are preferably connected in series with the internal tubing between a supply of cold transfer liquid and a load to be heated thereby; the liquid cooled by the load could be continuously returned to the supply in a closed circuit.

Half-pipes utilized for this purpose can be disposed meanderingly or spirally on the top and bottom surfaces and helically or helicoidally around the peripheral housing wall. The helix may be given a variable pitch to reduce the spacing of its turns in areas of high thermal stress and increase that spacing in other areas.

BRIEF DESCRIPTION OF THE DRAWING

The above and other features of my present invention will now be described in detail with reference to the accompanying drawing the sole FIGURE of which is an elevational view, partly in section, of a heat exchanger representing a preferred embodiment.

SPECIFIC DESCRIPTION

As shown in the drawing, a heat exchanger according to my invention comprises a cylindrical housing of steel with a lower peripheral wall 1 and an upper peripheral wall 12 of larger diameter centered on a vertical axis, a flat top 2, and a flat bottom 3. Inserted into the bottom is a burner 4, e.g. of oil or gas, developing combustion gases which rise to the top of the housing and after deflection descend to a lateral exit port 10 located just above a peripheral flange 14 which separated the lower and upper housing walls 1 and 12 from each other. These walls may be about equal in height.

The interior of the housing contains tubing for the circulation of an organic liquid to be heated by the combustion gases, this tubing forming a triple helix 6 with interleaved turns defining a cylindrical coil 5 positioned closed to the inner surface of lower wall 1. Near the housing top 2 the coil 5 merges into a similar but descending coil 9 with turns 8 extending between the turns of the rising coil 5 and the surrounding upper wall 12. The turns of both coils are tightly juxtaposed so as to form solid cylindrical partitions; the clearances between the coils and adjacent wall 12 open downwardly into an annular space 13 communicating with exit port 10. Thus, the rising combustion gases flow toward top 2 along the inner surface of coil 5 and then descend through the clearances referred to, on both sides of coil 9, into space 13 before escaping through port 10.

In accordance with my present invention, the heat-exchanger housing is provided over a large portion of its outer surface with serially interconnected conduits forming meandering passes 16' below bottom 3 and helicoidal turns 19 around upper wall 12. As indicated by dot-dash lines, these external conduits also lie in series with the internal coils 5 and 9. Thus, an organic liquid such as oil enters the upper conduit 16 at an inlet 18, flows from an outlet 17 thereof to an inlet 20 of helicoid 19, leaves the latter an an outlet 21 to enter an inlet 18' of lower conduit 16', then passes from an outlet 17' of that conduit to an inlet 7 communicating via a manifold 22 with the three sets of helical turns 6 of coil 5 whence it transfers at the top to the three sets of helical turns 8 of coil 9 and exits from that coil by way of another manifold 23 at an inlet 15. In the present instance, therefore, the liquid passes first through the outer conduits and then through the inner ones; the opposite arrangement could also be used.

Conduits 16, 16' and 19 are constituted by half-pipes whose semicircular cross-sections are open toward the adjoining outer housing surfaces onto which these half-pipes are welded. This insures optimum heat transmission across the housing walls. It should also be noted that the helicoidal turns 19 are of varying pitch and are most densely distributed near the top of the heat exchanger where the combustion gases undergo deflection and their heating effect is greatest. The spacing of these turns from one another increases progessively down to the level of port 15 which lies just above the annular space 13. The deflected gases pass around internal coil 9 within the annular clearance existing between coil 5 and wall 12.

Since inner coil 5 prevents the rising combustion gases from reaching the lower wall 1, this wall need not be enveloped by turns 19.

Burner 4, seated in a central aperture of bottom 3, could also be replaced as a source of hot gases by a duct leading from an external burner to that aperture. Not illustrated are three or more legs by which the heat-exchanger housing is mounted on a supporting surface to provide the necessary space for connections 17', 18' and for the burner or its discharge duct. The meandering passes 16, 16' of the external upper and lower conduits could be replaced by respective spiral windings or any other configuration enabling the traversing cooling fluid to be in direct contact throughout with housing top 2 housing bottom 3, respectively.

I claim:

1. A heat exchanger comprising: a generally cylindrical metallic housing with a peripheral wall centered on a vertical axis, a substantially flat bottom and a substantially flat top;

a source of combustion gases at said bottom, said housing being provided with an exit port for said combustion gases at a level substantially above said bottom;

tubing in said housing traversed by an organic liquid to be heated by said combustion gases; and conduit means in contact with outer surfaces of said housing for the passage of a cooling fluid absorbing some of the heat generated in said housing, said conduit means comprising a multiplicity of channels open toward said outer surfaces, said channels passing in a multiplicity of helicoidal turns around at least part of said peripheral wall, said cylinder wall being divided into a lower part of smaller diameter and an upper part of larger diameter, said tubing forming an inner coil with closely adjoining turns extending within said housing over nearly the full height thereof and an outer coil closely adjoining turns surrounding said inner coil within said upper part, said exit port being located near the junction of said lower and upper parts whereby combustion gases rising inside said inner coil are deflected at said top and descend along said outer coil to said exit port, said helicoidal turns being of varying pitch with minimum spacing in the vicinity of said top.

2. A heat exchanger as defined in claim 2 wherein said channesl are connected in series with said tubing for carrying said organic liquid as a cooling fluid.

3. A heat exchanger as defined in claim 1 wherein said channels also occupy the outer surfaces of said top and bottom.

4. A heat exchanger as defined in claim 3 wherein said channels are formed by metallic half-pipes open toward said outer surfaces and welded onto same.

5. A heat exchanger as defined in claim 1 wherein said turns are omitted on said lower part.

6. A heat exchanger as defined in claim 1 wherein said junction is defined by a peripheral flange on said periheral wall forming a lower boundary of an inner annular space between said peripheral wall and said inner coil, said outer coil terminating above said annular space, said exit port opening into said annular space.

7. A heat exchanger as defined in claim 1 wherein said source of combustion gases is a burner mounted in said bottom.

* * * * *